US010344973B1

(12) United States Patent
Gotzmer et al.

(10) Patent No.: US 10,344,973 B1
(45) Date of Patent: Jul. 9, 2019

(54) APPARATUS FOR INCINERATING EXPLOSIVE DEVICES AND BIOLOGICAL AGENTS

(71) Applicant: Department of the Navy, Indian Head, MD (US)

(72) Inventors: Carl Gotzmer, Accokeek, MD (US); Steven S. Kim, Crofton, MD (US); Brian Amato, Fairfax, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 102 days.

(21) Appl. No.: 15/732,475

(22) Filed: Nov. 17, 2017

(51) Int. Cl.

| | |
|---|---|
| ***F23G 5/00*** | (2006.01) |
| ***F23G 5/50*** | (2006.01) |
| ***F23G 5/08*** | (2006.01) |
| ***F23G 5/44*** | (2006.01) |
| ***F42B 33/06*** | (2006.01) |
| ***F23G 7/00*** | (2006.01) |

(52) U.S. Cl.
CPC ..... *F23G 5/50* (2013.01); *F23G 5/08* (2013.01); *F23G 5/448* (2013.01); *F23G 7/003* (2013.01); *F42B 33/067* (2013.01); *F23G 2202/30* (2013.01); *F23G 2204/101* (2013.01); *F23G 2209/16* (2013.01); *F23G 2900/00* (2013.01)

(58) Field of Classification Search
CPC ... F23G 5/08; F23G 5/50; F23G 5/448; F23G 7/00; F23G 7/003; F42B 33/067
See application file for complete search history.

(56) References Cited

U.S. PATENT DOCUMENTS

| | | | | |
|---|---|---|---|---|
| 3,195,608 A | | 7/1965 | Voorheis | |
| 3,452,690 A | | 7/1969 | Tarbox | |
| 3,464,249 A | * | 9/1969 | Winfried | B21D 26/08 228/2.5 |
| 3,499,400 A | * | 3/1970 | Altmann | F23G 5/18 110/189 |
| 3,604,375 A | | 9/1971 | Bruns | |
| 3,611,766 A | * | 10/1971 | Winfried | B21D 26/08 72/56 |
| 3,820,435 A | * | 6/1974 | Rogers | F42B 33/067 73/35.17 |
| 3,843,329 A | * | 10/1974 | Longley | F23G 7/065 110/213 |

(Continued)

FOREIGN PATENT DOCUMENTS

| | | |
|---|---|---|
| GB | 2269222 | 2/1994 |

*Primary Examiner* — Nathaniel Herzfeld
(74) *Attorney, Agent, or Firm* — Fredric J. Zimmerman

(57) ABSTRACT

An incinerator has a spherical chamber body to define an incineration chamber and includes a port structure with an opening that provides access to the incineration chamber. A hatch is pivotably attached to the port structure to provide access to the opening or to close the opening in the port structure. An incendiary device support member located within the incineration chamber to hold an ignitable incendiary device. A flammable panel member is located within the incineration chamber and positioned over the incendiary device support member. The panel member supports IEDs, explosive devices or biological agents for incineration. When the ignitable incendiary device is ignited, thermal energy is produced to incinerate the IEDs, explosive devices or biological agents positioned on the panel member.

20 Claims, 5 Drawing Sheets

(56) References Cited

U.S. PATENT DOCUMENTS

| | | | | | |
|---|---|---|---|---|---|
| 3,848,548 | A | | 11/1974 | Bolejack | |
| 3,905,272 | A | * | 9/1975 | Johnson | F42B 33/06 86/50 |
| 4,027,601 | A | * | 6/1977 | Hickerson | F42B 39/14 109/1 R |
| 4,079,612 | A | * | 3/1978 | Smirnov | B21D 26/08 29/421.2 |
| 4,081,982 | A | * | 4/1978 | Minin | B21D 26/08 29/421.2 |
| 4,187,758 | A | * | 2/1980 | Petty | F42B 39/14 109/74 |
| 4,437,382 | A | * | 3/1984 | Yerushalmi | F42D 5/04 86/50 |
| 4,438,708 | A | * | 3/1984 | Duff | F23G 5/00 110/239 |
| 4,478,350 | A | * | 10/1984 | Ohlsson | G01N 33/227 109/1 S |
| 4,889,258 | A | * | 12/1989 | Yerushalmi | B65F 1/14 220/560.01 |
| 5,419,862 | A | * | 5/1995 | Hampel | B08B 15/023 264/101 |
| 5,495,812 | A | | 3/1996 | Schulze | |
| 5,649,325 | A | | 7/1997 | Garrison et al. | |
| 5,727,481 | A | | 3/1998 | Voorhees | |
| 6,260,464 | B1 | * | 7/2001 | Gorrell | B09B 5/00 102/293 |
| 7,819,046 | B2 | * | 10/2010 | Ohlson | F42D 5/04 86/50 |
| 8,621,973 | B2 | * | 1/2014 | Abbe | F42D 5/045 86/50 |
| 2003/0051648 | A1 | * | 3/2003 | Braithwaite | F23G 5/40 110/237 |
| 2008/0245978 | A1 | * | 10/2008 | Yanke | F42B 39/14 250/515.1 |

* cited by examiner

APPARATUS FOR INCINERATING EXPLOSIVE DEVICES AND BIOLOGICAL AGENTS

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

FIELD OF THE INVENTION

The present invention relates to an apparatus for incinerating explosive devices and biological agents.

BACKGROUND

During military combat operations, enemy combatants and terrorists frequently use improvised explosive devices (IEDs) against troops and vehicles. IEDs are typically constructed of conventional military explosives such as mines, artillery rounds, grenades, dynamite and other explosive material such as C2 explosives. However, other nonmilitary grade explosives or pyrotechnic materials can be used as well. IEDs are typically used as roadside bombs that are detonated by wireless devices such as cell phones or handheld transmitters. Biological agents also may be used in combination with an IED in order to affect dispersal of vector-borne biological agents for the purpose of creating a patho-physiological toxic effect. Military troops in the field as well as law enforcement personnel are frequently tasked with locating IEDs and disposing of them. However, once the IEDs are located, it may be difficult, tedious, time consuming and dangerous to transport the IED to another location for disposal.

What is needed is a portable apparatus for safely incinerating IEDs, biological agents and other explosive devices.

SUMMARY OF THE INVENTION

It is an aspect of the invention to provide an incinerator that includes a spherical chamber body having an incineration chamber. The spherical chamber body includes a port structure that has an opening to provide access to the incineration chamber. A hatch is pivotably attached to the port structure to provide access to the opening in the port structure or to close the opening in the port structure. An incendiary device support member is located within the incineration chamber and is configured to hold an ignitable incendiary device. A flammable panel member is located within the incineration chamber and positioned over the incendiary device support member. The flammable panel member supports IEDs, explosive devices or biological agents that are to be incinerated. When the ignitable incendiary device is ignited, thermal energy is produced, which incinerates the IEDs, explosive devices and biological agents positioned on the flammable panel member. The incinerator is portable and is transportable to locations where IEDs, explosive devices or biological agents are located.

It is another aspect of the invention to provide an incinerator that includes a substantially spherical chamber body having an incineration chamber and a port structure that defines an opening to provide access to the incineration chamber, a hatch pivotally attached to the port structure and pivotable to an open position to allow access to the opening in the port structure and to a closed position, which closes the opening in the port structure, an incendiary device support member located within the incineration chamber and configured to hold an ignitable incendiary device, and a flammable panel member located within the incineration chamber and positioned over the incendiary device support member. The IEDs, explosive devices or biological agents to be incinerated are supported by the flammable panel member.

DETAILED DESCRIPTION OF EXEMPLARY EMBODIMENTS

Figure 1:
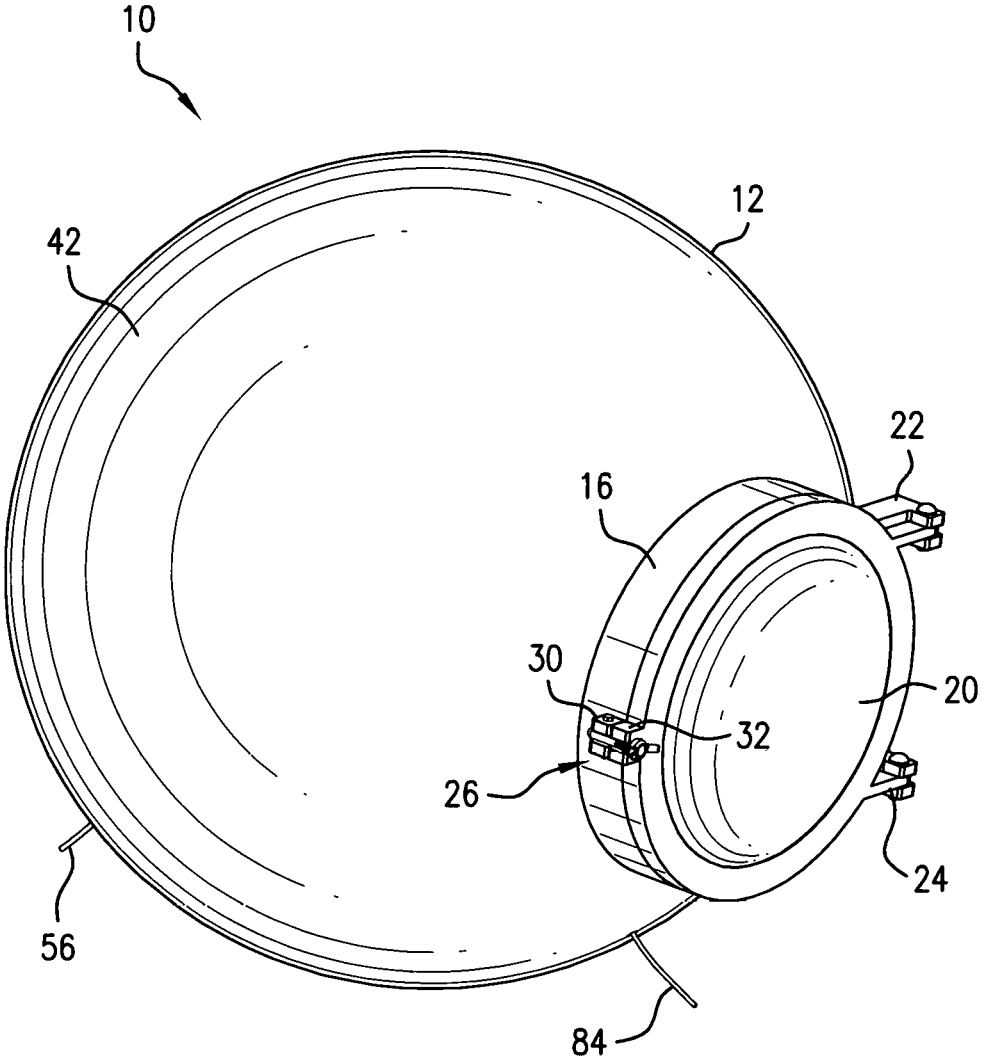
FIG. 1 is a perspective view of an incinerator for incinerating IEDs, explosive devices and biological agents in accordance with an exemplary embodiment of the present invention, the view showing the incinerator hatch locked in a closed position.
Figure 2:
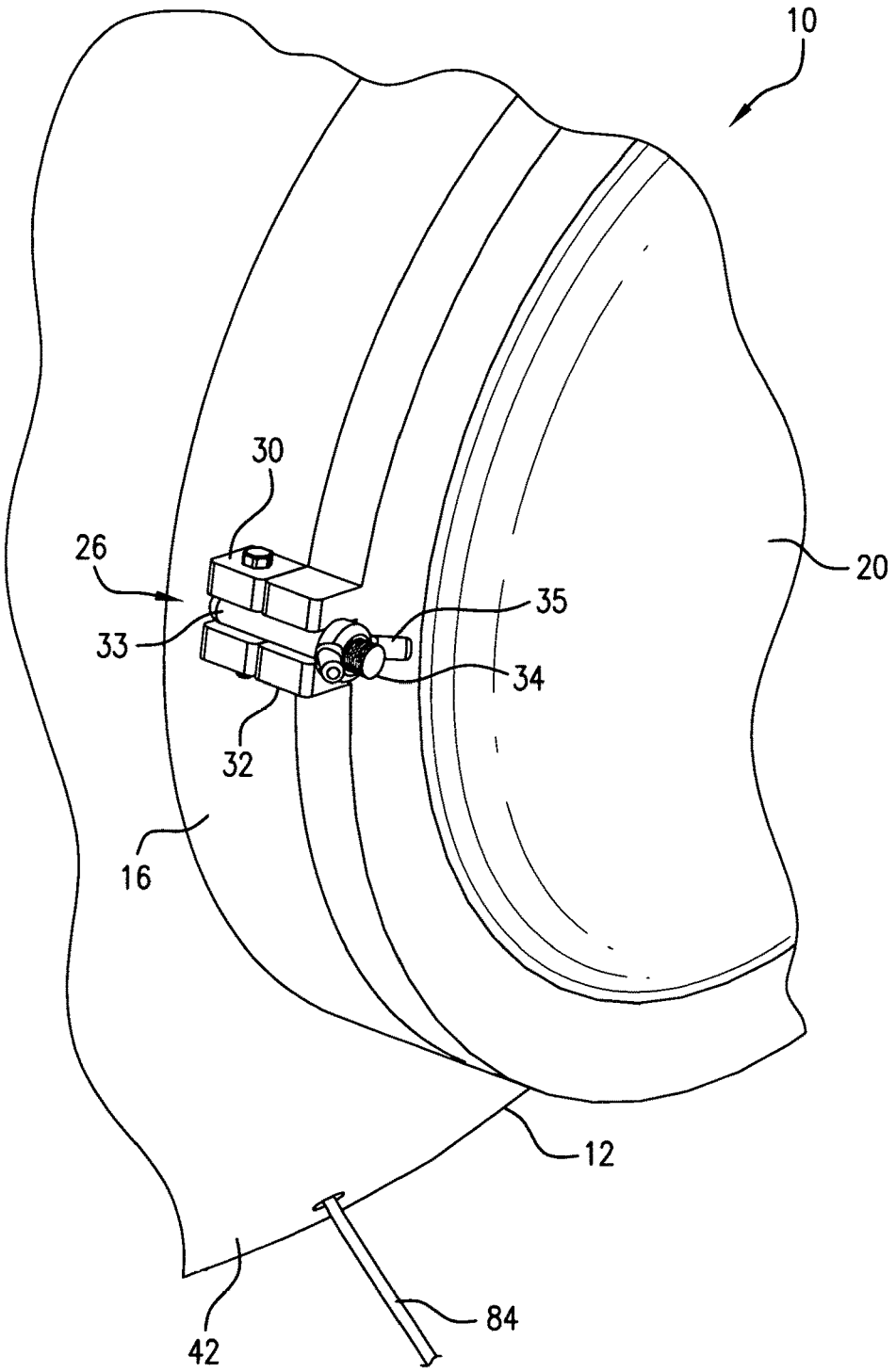
FIG. 2 is an enlarged view of a portion of the view of FIG. 1, the view showing a locking device for locking the hatch closed.
Figure 3:
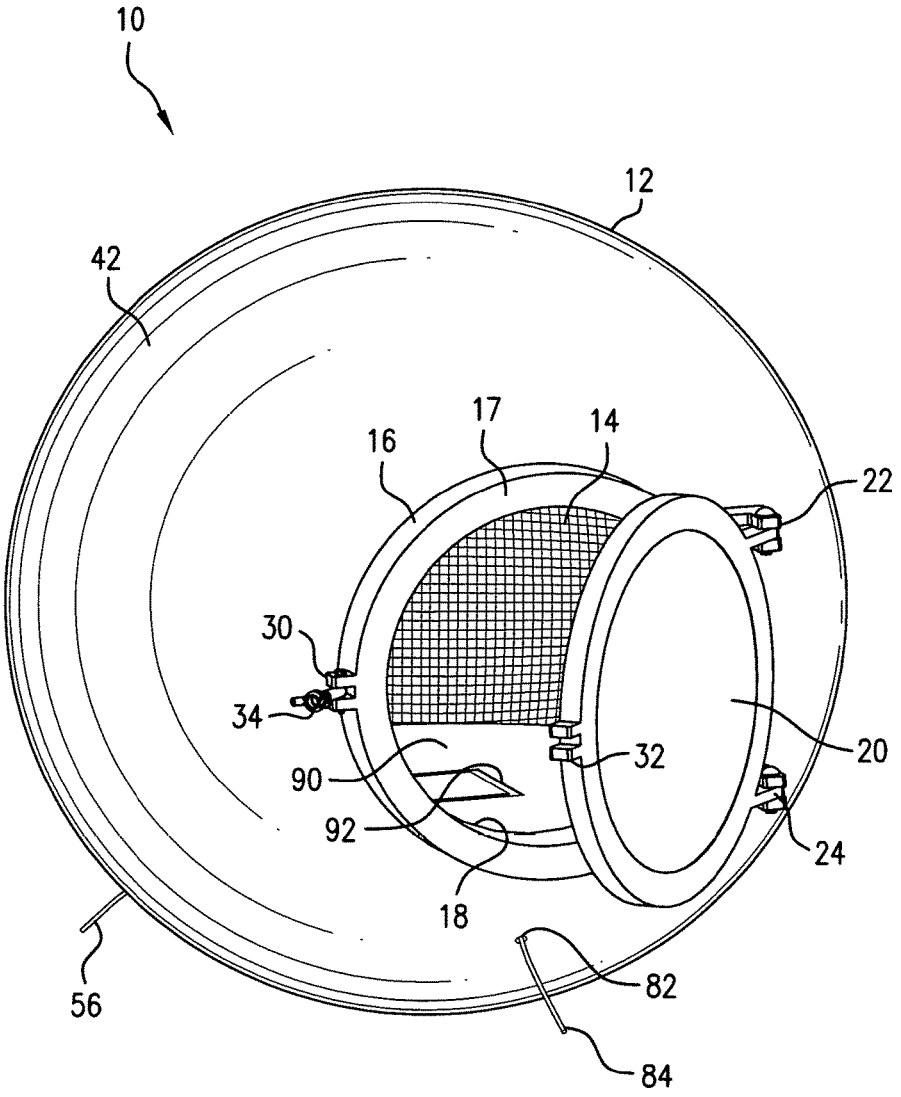
FIG. 3 is another perspective view of the incinerator, the view showing the incinerator hatch in an open position.
Figure 4:
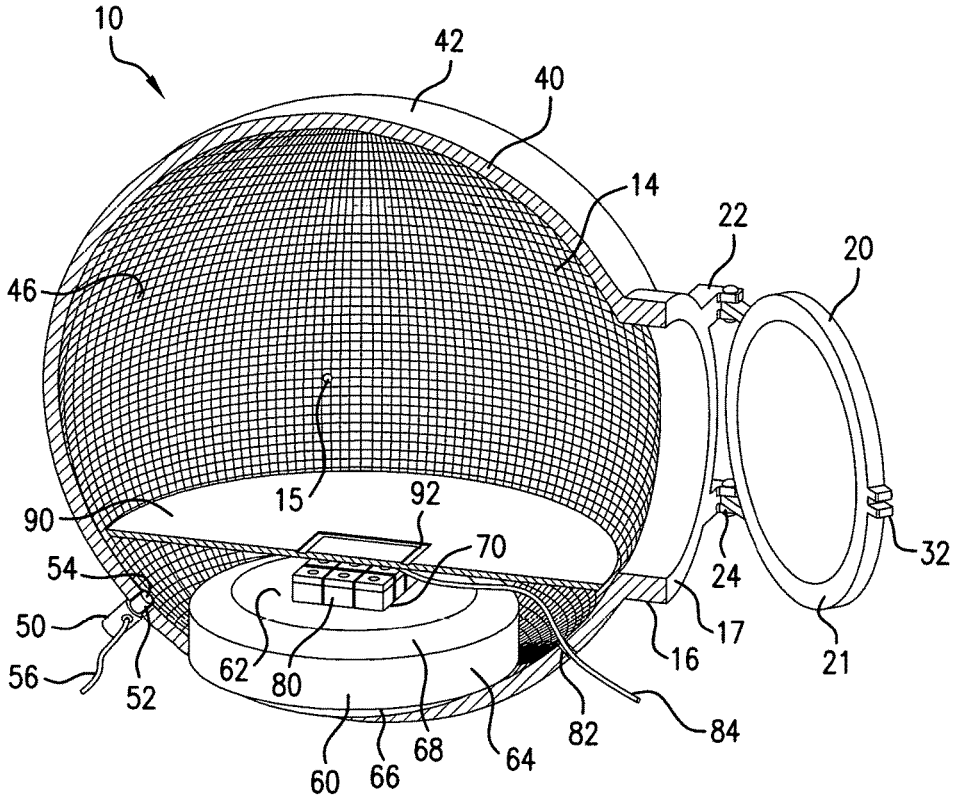
FIG. 4 is a cross-sectional view, in perspective, of the incinerator chamber.

Referring to FIGS. 1, 3 and 4, there is shown incinerator 10 in accordance with an exemplary embodiment of the invention. Incinerator 10 includes substantially spherical chamber body 12, which defines incineration chamber 14. The mathematical center of spherical chamber body 12 is indicated by reference number 15. Spherical chamber body 12 includes port structure 16 that extends from spherical chamber body 12. Port structure 16 includes face portion 17. In an exemplary embodiment, port structure 16 extends radially from center 15. Port structure 16 defines opening 18, which provides access to the incineration chamber 14. In an exemplary embodiment, port structure 16 has a substantially circular shape. It has been found that during the incineration of an IED, explosive device or biological agent within incineration chamber 14, the spherical shape of spherical chamber body 12 causes maximum reflection of thermal radiation onto the IED, explosive device or biological agent.

Referring to FIGS. 1-4, incinerator 10 further includes a hatch 20 that is pivotally attached to the port structure 16. Hatch 20 is pivotable to an open position that allows access to opening 18 of port structure 16 and to a closed position that closes opening 18. Hatch 20 has an inner face 21. Incinerator 10 includes hinge 22 and hinge 24. Hinge 22 and hinge 24 each have a first section that is attached to port structure 16 and a second portion that is movable with respect to the first section and is attached to hatch 20. In some embodiments, incinerator 10 uses only a single hinge for hatch 20. Incinerator 10 includes lock device 26 for locking the hatch 20 in the closed position. Lock device 26 includes a first section 30, which is attached to port structure 16, and a second section 32, which is attached to the hatch 20 and configured for locking engagement with first section 30. Lock device 26 includes "L" shaped bolt 33, which is movably attached to first section 30. "L" shaped bolt 33 includes threaded head 34 and a wing nut 35. Once the hatch 20 is closed, a user moves "L" shaped bolt 33 so that it engages the second section 32 and tightens wing nut 35.

Referring to FIG. 4, spherical chamber body 12 includes wall 40, which is capable of handling internal explosions. Wall 40 has exterior surface 42 and an interior surface that forms incineration chamber 14 and which is lined with heat insulative material 46. Heat insulative material 46 protects the wall 40. In an exemplary embodiment, heat insulative material 46 is graphite. In another exemplary embodiment, heat insulative material 46 is ceramic. Other suitable heat insulative materials may be used as well. In other embodiments, incinerator 14 does not utilize heat insulative material 46 on the interior surface of wall 40. In some embodiments, the thickness of wall 40, excluding the layer of heat insulative material 46, is between about 1.0 inch and about 5.0 inches. A more particular range is between about 1.0 inch and about 3.0 inch. An even more particular range is between about 1.0 inch and about 2.0 inches. However, it is to be understood that the wall 40 may have a thickness other than the foregoing exemplary thicknesses. In an exemplary embodiment, spherical chamber body 12, port structure 16, hatch 20, hinge 22, hinge 24 and lock device 26 are made from steel. However, other suitable metals may be used to fabricate spherical chamber body 12, port structure 16, hatch 20, hinge 22, hinge 24 and lock device 26.

Referring to FIGS. 1 and 4, incinerator 10 further includes pressure relief valve 50. In an exemplary embodiment, pressure relief valve 50 is connected to wall 40 of spherical chamber body 12. In such an exemplary embodiment, spherical chamber body 12 has a threaded through-hole 52 and pressure relief valve 50 is configured with threads 54 that allow it to be screwed into threaded through-hole 52. When pressure relief valve 50 is opened, the pressure within incineration chamber 14 is vented thereby reducing the pressure within incineration chamber 14. Once the pressure within incineration chamber 14 is reduced, the user or operator can safely open hatch 20. In an exemplary embodiment, pressure relief valve 50 is an electronically controlled pressure relief valve and receives electrical signals through electrical wire 56, which is electrically connected to pressure relief valve 50. The electrical signals are provided by a remote control device (not shown) that is operated by the users of incinerator 10. In another embodiment, pressure relief valve 50 is a mechanical pressure relief valve that is manually opened and closed. In a further embodiment, pressure relief valve 50 is a spring-loaded pressure relief valve that automatically vents incineration chamber 14 when the pressure within incineration chamber 14 rises to a predetermined level. In some embodiments, the pressure relief valve 50 is mounted to hatch 20.

Referring to FIGS. 3 and 4, incinerator 10 includes incendiary device support member 60 that is positioned on the bottom of incinerator chamber 14. In an exemplary embodiment, incendiary device support member 60 is generally circular in shape. However, incendiary device support member 60 may be configured to have other suitable shapes as well. Incendiary device support member 60 includes a top side 62, sidewall 64 and bottom side 66. Top side 62 includes a beveled edge portion 68. Incendiary device support member 60 includes a hole or cavity 70 that is sized to receive ignitable incendiary device 80. Hole 70 is sized to provide a snug fit between ignitable incendiary device 80 and the inner walls of the hole or cavity 70. In an exemplary embodiment, hole 70 is substantially square-shaped and ignitable incendiary device 80 is substantially square-shaped. However, it is to be understood that the hole 70 and ignitable incendiary device 80 may have other suitable shapes, e.g. rectangular, circular, triangular, etc. In some embodiments, incendiary device support member 60 is fabricated from a metal, including but not limited to, steel, iron, nickel, titanium and copper. In other embodiments, incendiary device support member 60 is fabricated from a fire resistant non-metal material. In some embodiments, incendiary device support member 60 is configured to have a plurality of sections where each section may be inserted through opening 18 separately and assembled at the bottom of incineration chamber 14. Such an embodiment allows the user to replace, quickly, incendiary device support member 60 if necessary. Thus, in an exemplary embodiment, incendiary device support member 60 is configured to have two sections. In other embodiments, incendiary device support member 60 may be configured to have more than two sections.

As shown in FIG. 4, incinerator 10 includes panel member 90, that is, has a particular diameter, which allows it to be positioned above ignitable incendiary device 80 by a predetermined distance. In an exemplary embodiment, the distance between panel member 90 and ignitable incendiary device 80 is about six inches. However, this distance may be varied depending upon the type of ignitable incendiary device 80 that is being used. Panel member 90 has marking or other indicia 92 that indicates the area upon which the IED, explosive device or biological agent is to be placed. Marking 92 is substantially centered on panel member 90 so that when panel member 90 is in position as shown in FIG. 4, marking 92 is positioned directly over ignitable incendiary device 80. In an exemplary embodiment, marking 92 is in the shape of square to correspond to the square shape of ignitable incendiary device 80. Panel member 90 is made from a flammable material. In an exemplary embodiment, panel member 90 is made from plastic. Other suitable materials may be used as well to fabricate panel member 90, including wood, cardboard, plexiglass, wallboard, and other materials. When ignitable incendiary device 80 is ignited, the flame and thermal energy burn through the portion of panel member 90 designated by marking 92. In an exemplary embodiment, panel member 90 is configured as a multi-section panel where each panel section may be inserted through or removed from opening 18. Such a configuration allows panel member 90 to be easily replaced through opening 18. In an exemplary embodiment, panel member 90 is configured to have two sections. In other embodiments, panel member 90 may be configured to have more than two sections. In some embodiments, panel member 90 includes a thickness between about 0.25 inch and about 1.0 inch. However, in other embodiments, panel member 90 may have other suitable thicknesses.

Referring to FIG. 4, ignitable incendiary device 80 is configured to ignite upon receiving electrical signals and provides the thermal source for destroying the IED, biological agent or other explosive device. In an exemplary embodiment, incinerator 10 includes through-hole 82 through which electrical ignition wire 84 may be inserted. Electrical ignition wire 84 is electrically connected to electrical connectors (not shown) on ignitable incendiary device 80. Upon receiving an electrical signal via electrical ignition wire 84, ignitable incendiary device 80 ignites thereby producing the necessary thermal energy to incinerate the IED, explosive device or biological agent. In an exemplary embodiment, ignitable incendiary device 80 may be a high temperature incendiary device as described in know patentable technology. Ignitable incendiary device 80 may include a plurality of incendiary devices. A suitable commercially available incendiary device is known as the "Vulcan Fire Candle." In one embodiment, ignitable incendiary device 80 includes a plurality of Vulcan Fire Candles. The portion of electrical ignition wire 84 outside spherical chamber body 16 is electrically connected to a source of electrical signals (not shown). As used herein, the term "electrical signal" shall include AC (alternating current) signals, DC (direct current) voltages, pulses or pulsed waveforms and radio frequency (RF) signals. In some embodiments, ignitable incendiary device 80 is remotely ignited. In such an embodiment, ignitable incendiary device 80 has electrical circuitry that receives an RF (radio frequency) signal through an antenna wire (not shown) that extends through through-hole 82. In response, the electrical circuitry generates an electrical signal that causes ignition of the ignitable incendiary device 80. The RF signal may be generated and transmitted by a handheld transmitter, a smart phone or a VHF or UHF transceiver used in military or law enforcement vehicles. In another embodiment, through-hole 82 is in hatch 20.

In some embodiments, a sealant is applied to threaded through-hole 52 prior to screwing in the pressure relief valve 50 in order to create a seal that prevents leakage of toxic or dangerous gases during the incineration process. Similarly, in some embodiments, after electrical ignition wire 84 is inserted into through-hole 82, a sealant is infused into any spaces between electrical ignition wire 84 and the inner wall of through-hole 82 in order to create a seal that prevents leakage of toxic or dangerous gases during the incineration process. In some embodiments, a circular seal member (not shown) is affixed to face portion 17 of port structure 16 to create a seal when hatch 20 is locked so as to prevent leakage of toxic or dangerous gases during the incineration process. In some embodiments, the circular seal member (not shown) is affixed to inner face 21 of hatch 20.

Referring to FIG. 1, the actual size of incinerator 10 depends upon the type of IED or explosive material that will be incinerated. In an exemplary embodiment, incinerator chamber 14 has an inner diameter of about twenty-four inches. In some exemplary embodiments, incineration chamber 14 has an inner diameter that is greater than twenty-four inches.

The shape and design of incinerator 10 allows it to be portable such that it can be easily transported to the location of the IED, explosive device or biological agent for incineration. Incinerator 10 may be mounted on a flatbed truck, trailer, pick-up truck or other suitable vehicle. Incinerator 10 may be secured to an air-drop pallet and dropped into the combat zone via parachute. Incinerator 10 also may be delivered to the area via helicopter. As a result of the particular shape of spherical chamber body 14, explosive devices, IEDs and biological agents are completely and safely incinerated.

Figure 5:
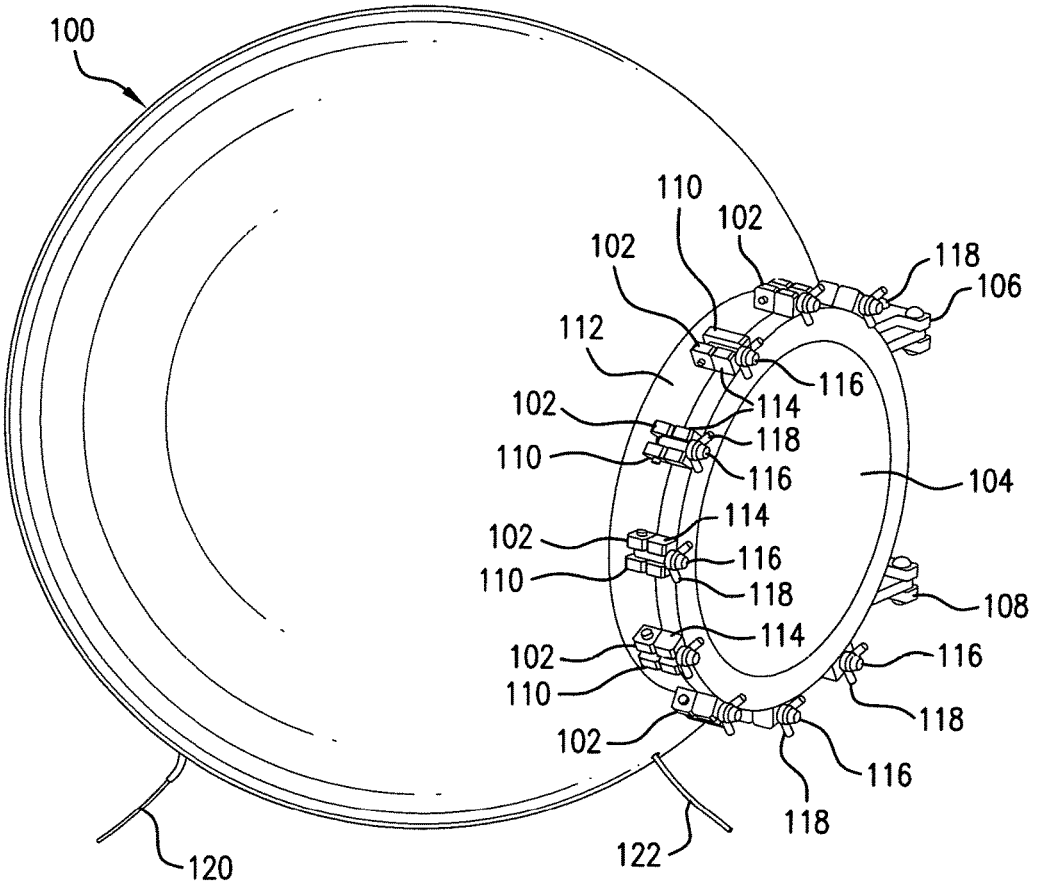
FIG. 5 is a perspective view of an incinerator for incinerating IEDs, explosive devices and biological agents in accordance with another exemplary embodiment of the present invention.

Referring to FIG. 5, there is shown incinerator 100 in accordance with another exemplary embodiment. Incinerator 100 has substantially the same structure as incinerator 10 except that incinerator 100 includes a plurality of lock devices 102 configured to lock hatch 104 in the closed position. Incinerator 100 includes hinge 106 and hinge 108, which have the same structure and configuration as hinge 22 and hinge 24, respectively. Each lock device 102 has the same configuration and structure as lock device 26 described in the foregoing description. Thus, each lock device 102 includes first section 110, which is attached to port structure 112, and a second section 114, which is attached to hatch 104 and configured for locking engagement with first section 110 using "L" shaped bolt 116 and nut 118. Gaskets or seals (not shown) may be used on hatch 104 or port structure 112 to provide a tight seal when hatch 104 is locked closed. The plurality of lock devices 102 ensures hatch 104 will remain closed and locked when there is high pressure within the incineration chamber of incinerator 100. Electrical wires 120 and 122 provide the same functions as electrical wires 56 and 84, respectively.

The foregoing description, for purpose of explanation, has been described with reference to specific exemplary embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

Finally, any numerical parameters set forth in the specification and attached claims are approximations (for example, by using the term "about") that may vary depending upon the desired properties sough to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An incinerator, comprising:

a substantially spherical chamber body defining an incineration chamber where the incineration chamber includes a port structure for defining an opening, which provides access to the incineration chamber;

a hatch pivotally being attached to the port structure and being pivotable to an open position for allowing access to the opening in the port structure and to a closed position for closing the opening in the port structure;

an incendiary device support member being located within the incineration chamber and being configured for holding an ignitable incendiary device; and a panel member being located within the incineration chamber and being positioned over the incendiary device support member for supporting at least one of IEDs, explosive devices and biological agents for incineration.

2. The incinerator according to claim 1, wherein the incinerator chamber includes a center, and wherein the port structure extends radially with respect to the center.

3. The incinerator according to claim 1, wherein the port structure includes a substantially circular shape.

4. The incinerator according to claim 1, wherein the spherical chamber body comprises a wall having an exterior surface and an interior surface to form the incineration chamber.

5. The incinerator according to claim 4, further comprising a heat insulative material being disposed over the interior surface.

6. The incinerator according to claim 1, wherein the panel member is spaced apart from the incendiary device support member.

7. The incinerator according to claim 1, wherein the panel member is comprised of a flammable material.

8. The incinerator according to claim 7, wherein the flammable material is comprised of a plastic material.

9. The incinerator according to claim 1, wherein the incendiary device support member includes a cavity therein to receive an ignitable incendiary device, wherein the panel member is substantially aligned with the cavity in the incendiary device support member, and wherein an area in which said at least one of said IEDs, said explosive device and said biological agent is placed.

10. The incinerator according to claim 1, further comprising an ignitable incendiary device being supported by the incendiary device support member.

11. The incinerator according to claim 10, wherein the ignitable incendiary object is configured to ignite upon receipt of an electrical signal.

12. The incinerator according to claim 10, wherein the ignitable incendiary object is configured to ignite upon receipt of an electrical signal, and wherein the spherical chamber body includes a through-hole to insert an electrical ignition wire.

13. The incinerator according to claim 10, wherein the ignitable incendiary object is configured to ignite upon receipt of an electrical signal, wherein the spherical chamber body includes a through-hole to insert an electrical ignition wire, wherein the electrical ignition wire is disposed through the through-hole in the spherical chamber body, and wherein the electrical ignition wire is electrically connected to the ignitable incendiary device.

14. The incinerator according to claim 1, further comprising at least one lock device for locking the hatch in the closed position.

15. The incinerator according to claim 1, further comprising at least one hinge comprising a first section being attached to the port structure and a second section being movable with respect to the first section and being attached to the hatch.

16. The incinerator according to claim 1, further comprising a pressure relief valve on the spherical chamber body for venting pressure within the incineration chamber.

17. The incinerator according to claim 16, wherein the pressure relief valve is an electric pressure relief valve, which opens upon receiving an electrical signal.

18. The incinerator according to claim 1, wherein the wall of the spherical chamber body includes a thickness between about one inch and about five inches.

19. The incinerator according to claim 1, wherein the spherical chamber body is sized such that the incineration chamber includes a diameter of at least about twenty-four inches.

20. The incinerator according to claim 1, wherein the spherical chamber body, port structure and hatch are comprised of steel.

* * * * *